US010587030B2

(12) United States Patent
Brannon

(10) Patent No.: US 10,587,030 B2
(45) Date of Patent: Mar. 10, 2020

(54) SYSTEMS AND METHODS OF DESIGNING, TUNING AND PRODUCING CERAMIC FILTERS

(71) Applicant: LGS INNOVATIONS LLC, Herndon, VA (US)

(72) Inventor: Alan Scott Brannon, Denver, CO (US)

( * ) Notice: Subject to any disclaimer, the term of this patent is extended or adjusted under 35 U.S.C. 154(b) by 137 days.

(21) Appl. No.: 15/797,582

(22) Filed: Oct. 30, 2017

(65) Prior Publication Data

US 2018/0131069 A1 May 10, 2018

Related U.S. Application Data

(60) Provisional application No. 62/418,967, filed on Nov. 8, 2016.

(51) Int. Cl.
*H01P 11/00* (2006.01)
*H01P 1/201* (2006.01)
*H01P 1/205* (2006.01)

(52) U.S. Cl.
CPC ..... *H01P 11/007* (2013.01); *H01P 1/201* (2013.01); *H01P 1/2056* (2013.01)

(58) Field of Classification Search
CPC ..... H01P 11/007; H01P 1/201; H01P 1/2056
USPC ..... 333/207
See application file for complete search history.

(56) References Cited

U.S. PATENT DOCUMENTS 5,528,204 A * 6/1996 Hoang ..... H01P 1/2136 333/134
6,437,655 B1 8/2002 Andoh et al.
6,504,446 B1 1/2003 Ishihara et al.
7,042,314 B2 * 5/2006 Wang ..... H01P 1/2086 333/202
7,605,343 B2 * 10/2009 Lei ..... H05K 3/0035 219/121.71
2001/0016982 A1 8/2001 Blair et al.
(Continued)

OTHER PUBLICATIONS

Lisi et al. "Additive Manufacturing Enables Microwave Components for Space Applications", p. 8, paragraphs 1-2, Jun. 13, 2017. (Year: 2017).*

(Continued)

*Primary Examiner* — Benny T Lee
*Assistant Examiner* — Hafizur Rahman
(74) *Attorney, Agent, or Firm* — Baker & Hostetler LLP

(57) ABSTRACT

The present applications at least describes a method of making a tuned ceramic filter. The method includes printing an oversized pattern of ceramic material on a ceramic filter. The method also include removing, at a first tune location of the ceramic filter, a first amount of the ceramic material using a laser to shrink the oversized pattern. The method also includes comparing a coupling matrix of the ceramic filter after the removing step with a coupling matrix of a prototype of the ceramic filter. The method includes a step of generating a tune vector based upon a difference between the coupling matrix of the ceramic filter and the coupling matrix of the prototype filter. Further, the method includes a step of iteratively modifying the removing of the ceramic material using femto-second laser at the first tune location to have a coefficient of the tune vector corresponding to the first tune location to converge toward zero.

19 Claims, 7 Drawing Sheets

(56) References Cited

U.S. PATENT DOCUMENTS

2012/0012758 A1* 1/2012 Kajikawa ..... B23K 26/0617
250/492.1

OTHER PUBLICATIONS

KMLabs,"Femtosecond Laser", first published on https://www.kmlabs.com/femtosecond, on Jun. 22, 2018. (Year: 2018).*

Abdelmoneum et al., "Post-Fabrication Laser Trimming of Micromechanical Filters", Technical Digest, IEEE Int. Electron Devices Mtg., San Francisco, California, Dec. 13-15, 2004, pp. 39-42.

* cited by examiner

SYSTEMS AND METHODS OF DESIGNING, TUNING AND PRODUCING CERAMIC FILTERS

CROSS-REFERENCE TO RELATED APPLICATIONS

This application claims the benefit of priority of U.S. Provisional Application No. 62/418,967 filed Nov. 8, 2016, entitled, "Methods of Tuning, Designing and Producing Ceramic Filters" the contents of which is incorporated by reference in its entirety herein.

FIELD

This application is generally related to systems and methods for designing, producing and tuning ceramic and other printed filters. More specifically, this application is related to systems and methods for designing, producing and tuning recessed top ceramic filters.

BACKGROUND

Base stations for communications operate at power levels on the order of many watts. Implementations of duplex filters located in base stations having a single antenna for both transmit and receive operations typically include air cavity duplex filter designs. Such filter designs include multiple resonators which when tuned properly operate in concert to achieve filter performance needs. Resonators are coupled to each other through parasitic and other paths. Tuning a given resonator can affect the operation of other resonators because of cross coupling inherent in the design of such filters.

Air cavity filters are cost effective to manufacture using well known machining techniques. Air cavity filters can also handle high power levels. However, there are specialized applications where the size and weight of air cavity filters is prohibitive. In the interest of mining scarce bandwidth resources, base station serving areas are becoming much smaller. In fact, customers and operators prefer to minimize the footprint and mounting constraints for base stations. As a result, filters in the base stations need to be smaller.

Planar techniques, such as for example microstrip techniques, stripline techniques or other printed techniques, enable low cost design of printed filters, including ceramic filters with printed surfaces. Many types of printed planar filters or ceramic multi-resonator filters often have lot-to-lot or device-to-device performance variation that can cause performance to fall outside of specified tolerances. This may include shrinkage of the ceramic block, inaccuracies in the ceramic mixture, inaccuracies in the furnace firing, thickness variation of the plating, and errors in pattern positioning each have a large effect on part-to-part and lot-to-lot filter performance. Moreover, each filter must be manually tuned resulting in a laborious and expensive process requiring significant knowledge of the art.

Separately, printed planar filters or ceramic multi-resonator filters can be difficult to design particularly when the design incorporates both bulk field resonances and high E-field couplings. The design process for these filters initially involves simulating the filter resulting in an accurate prediction of the final filter performance. However, this does not provide much instruction on how to achieve the final performance. Conventional methods require the designer to use a laborious and expensive process that requires significant knowledge of the art to design the printed pattern that will yield the originally simulated performance.

What is needed is an automated tuning, design and manufacture method enabling low cost, precision manufacture of printed filters.

What is also needed is a faster and more stepwise approach to tuning filters, during production and post production in the field, which allows a less-trained technician, or an automated robotic system to tune each filter into compliance in a fast and cost-effective way.

What is further needed is a stepwise approach to design filters which guide the designer, technician, or computer in a way that causes the printed pattern to converge to the appropriate final design.

SUMMARY

The foregoing needs are met, to a great extent, by the invention, with an apparatus and method for designing, producing and tuning ceramic and other printed filters.

In accordance with an aspect of this application, a method of making a tuned ceramic filter is provided. The method includes a step of printing an oversized pattern of ceramic material on a ceramic filter. The method also includes a step of removing, at a first tune location of the ceramic filter, a first amount of the ceramic material using a laser. The laser may be, for example a femto-second (cold) laser, to shrink the oversized pattern. The method also includes a step of comparing a coupling matrix of the ceramic filter after the removing step with a coupling matrix of a prototype of the ceramic filter. The method further includes a step of generating a tune vector based upon a difference between the coupling matrix of the ceramic filter and the coupling matrix of the prototype filter. The method even further includes a step of iteratively modifying the removing of the ceramic material using the femto-second laser at the first tune location to have a coefficient of the tune vector corresponding to the first tune location to converge toward zero.

In accordance with another aspect of this application, a method for designing a ceramic filter is provided. The method includes a step of printing an oversized pattern of ceramic material on a ceramic filter. The method also includes a step of selecting a first tune location of the ceramic filter based upon simulated data of electrical characteristics of the ceramic filter. The method also includes a step of removing, at the first tune location, an amount of the ceramic material using laser to shrink the oversized pattern. The method also includes a step of measuring actual electrical characteristics of the ceramic filter after the removing step to generate a tune vector for the ceramic filter. The method also includes a step of comparing a tune vector with a simulated tune vector corresponding to the simulated data. Each of the tune vector and the simulated tune vectors are derived from an actual coupling matrix and a simulated coupling matrix, respectively, of the ceramic filter. Further, the method includes a step of iteratively modifying the simulated data and the amount of the ceramic material removed such that the tune vector and the simulated tune vector match.

In accordance with yet another aspect of this application, a system for laser based tuning of ceramic filters is provided. The system includes a processor, a memory coupled to the processor, the memory having non-transitory computer readable medium on which instructions are stored for laser tuning a recessed top ceramic filter. The instructions when executed by the processor cause the processor to position a femto-second laser source to a first tune location of the recessed top ceramic filter. The first tune location is selected based upon simulated data of electrical characteristics of the recessed top ceramic filter. The first tune location has an oversized pattern of ceramic material. The femto-second laser is turned on to emit a femto-second pulse on the ceramic material of the first tune location. The electrical characteristics of the recessed top ceramic filter are measured after removal of a portion of the ceramic material by the femto-second laser source. This generates a tune vector. The tune vector is compared with a simulated tune vector corresponding to simulated data for the recessed-top ceramic filter. Each of the tune vector and the simulated tune vectors are derived from an actual coupling matrix and a simulated coupling matrix, respectively, of the recessed-top ceramic filter. The simulated data and the amount of the ceramic material removed are iteratively modified such that the tune vector and the simulated tune vector match.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

BRIEF DESCRIPTION OF THE DRAWINGS

In order to facilitate a fuller understanding of the invention, reference is now made to the accompanying drawings, in which like elements are referenced with like numerals. These drawings should not be construed as limiting the invention and intended only to be illustrative.

DETAILED DESCRIPTION

Figure 1:
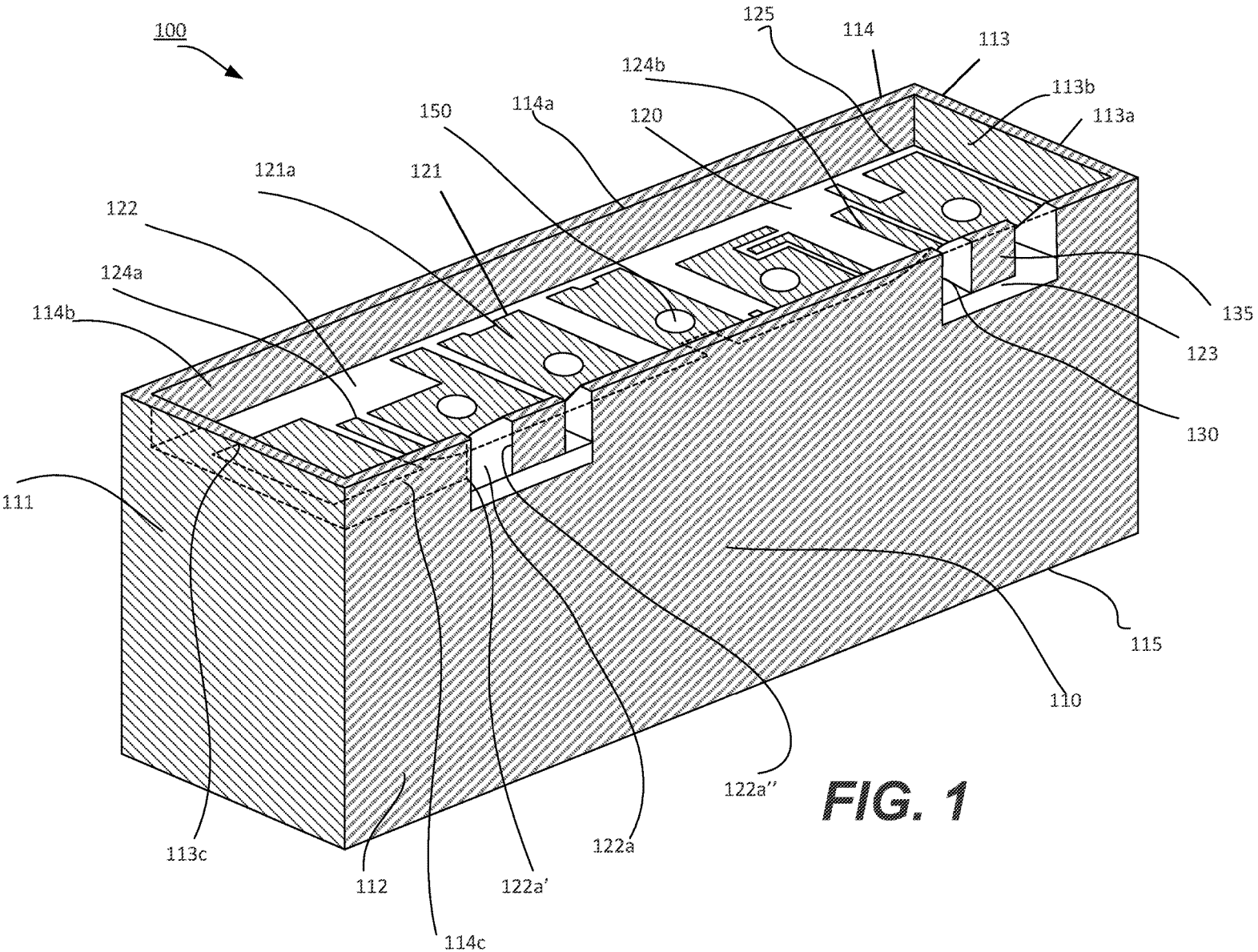
FIG. 1 illustrates a ceramic filter, according to the application.

In this respect, before explaining at least one embodiment of the invention in detail, it is to be understood that the invention is not limited in its application to the details of construction and to the arrangements of the components set forth in the following description or illustrated in the drawings. The invention is capable of embodiments or embodiments in addition to those described and of being practiced and carried out in various ways. Also, it is to be understood that the phraseology and terminology employed herein, as well as the abstract, are for the purpose of description and should not be regarded as limiting.

Reference in this application to "one embodiment," "an embodiment," "one or more embodiments," or the like means that a particular feature, structure, or characteristic described in connection with the embodiment is included in at least one embodiment of the disclosure. The appearances of, for example, the phrases "an embodiment" in various places in the specification are not necessarily all referring to the same embodiment, nor are separate or alternative embodiments mutually exclusive of other embodiments. Moreover, various features are described which may be exhibited by some embodiments and not by the other. Similarly, various requirements are described which may be requirements for some embodiments but not by other embodiments.

It has been determined by the inventors and described herein that the inventive techniques provide faster and less expensive design, tuning and production of the printed ceramic filters. By virtue of the aspects of this patent application, ceramic filters can further be tuned in in a test fixture. Prior to describing the setup and the process for designing, tuning and producing such ceramic filters, it will be beneficial to discuss certain structural aspects of the ceramic filters.

General Description of a Ceramic Filter

Ceramic filters are typically employed in radio equipment to reduce substantial interference. In particular, duplex ceramic filters including two individual band-pass filters are employed. One filter connects the receiving branch and has a center frequency and bandwidth corresponding to the receiving band. The other filter connects the transmission branch and has a center frequency and bandwidth corresponding to the transmission band.

Conventional ceramic filters include a dielectric ceramic material for the main body upon which metallic materials are applied for producing conducting paths. These paths define the performance of the filter and for realization of pads or other isolated conducting areas that contact the printed circuit board or other interface material.

Ceramic filters generally include a single type of material for all conduction paths, pads and other conductive elements. Typically, conducting-type material is deposited on the device through a process known as electroding. Often, there is a need for soldering or epoxy-attaching given devices to a printed circuit board. The strength of the conducting bond between a device and the board requires using a conducting material containing glass frit material in combination with pure silver conductive material. The conductivity of glass frit/silver material is significantly less than pure silver by about 10 fold, while adhesion of the glass frit/silver material is 10 fold that of pure silver.

Generally, a pattern of metallized and un-metallized areas is defined on a filter. The pattern includes a recessed area of metallization that covers at least a portion of the top surface and areas which cover the bottom and side surfaces, the through-holes, and at least a portion of the walls or posts.

FIG. 1 illustrates a radio frequency (RF) filter 100 in accordance according to an aspect of the application. The filter may be formed in any shape. In an exemplary aspect, core 110 includes a ceramic dielectric material having a desired dielectric constant.

The filter 100 includes four side surfaces. Two of the four side surfaces are minor side surfaces 111. The other two of the four side surfaces are major side surfaces 112. The filter 100 also includes a bottom surface 115 and a top-recessed surface 120 making the filter a recessed-top portion (RTP) type filter. The top surface 120 is generally parallel and opposed to the bottom surface 115. Once fabricated, the bottom surface 115 usually is attached to a printed circuit board (not shown), and is not easily accessible to a filter tuner.

The filter 100 also includes four generally planar walls that extend upwardly from the top surface 120. In one embodiment, the planar walls extend upwardly and/or outwardly along a perimeter of the top-recessed surface 120. In another aspect, the planar walls are unitary portions of the major 112 and minor 111 side surfaces. Planar walls of the minor side surfaces are 113, and planar walls of the major side surfaces are 114.

Walls 113, 114, and top surface 120 define a cavity 125. Top surfaces 113*a* of wall 113 and top surfaces 114*a* of wall 113 form a peripheral rim 115 of a predetermined thickness. The thickness of the roof is dependent upon the width and length of the cavity 125.

Inner walls 113*b* of wall 113 of the minor surface 111, inner walls 114*b* of wall 114 of the major surface 112, and the top surface 120 can be plated or deposited with a first coating.

In an aspect, outer walls 113*c* and 114*c* of walls 113 and 114 are coextensive and coplanar with major 111 and minor 112 surfaces, respectively. In one aspect, the roof 113*a*, 114*a* are planar. In another aspect, the roof slopes downward from the inner to outer surfaces of the walls 113, 114. In yet another aspect, the roof slopes upward from the inner to outer surfaces of the walls 113, 114. The slope are be envisaged to be any angle.

As shown in FIG. 1, planar wall 114 includes plural, spaced-apart slots 130. For example, the slots extend through the planar wall 114 from the inner 114*b* to the outer 114*c* surface. The slots 130 may have similar or different lengths extending between two minor side surfaces 111. In an aspect, a post 135 may be formed in the planar wall 114 between two spaced-apart slots 130. The plural posts 135 may have similar or different lengths.

The top surface 120 may include plural through-holes 150. The through-holes 150 extend from the top surface 120 to the bottom surface 115 (not shown) of the body 100. The through-holes 150 act as resonators. The through-holes are metallized. In an aspect, the through-holes 150 are aligned in a spaced-apart, co-linear relationship and are also equal distances from the side surfaces. Each of through-holes 150 is defined by an inner cylindrical metallized side-wall surface.

Top surface 120 additionally defines a surface-layer recessed pattern of electrically conductive metallized 121 and insulative, un-metallized 122 areas or patterns. The metallized areas 121 are preferably a surface layer of conductive silver-containing material. Recessed pattern 121 defines a wide area or pattern of metallization that covers the surface. In an embodiment, the recessed pattern 121, through-holes 150, and inner walls 113*b*, 114*b* are deposited with a first coating including a metal and frit. More specifically, the metal is a precious metal. Even more specifically, the metal is silver (Ag).

Meanwhile, the bottom surface 115, side surfaces 111, 112, outer planar walls 113*c*, 114*c*, and top rim 113*a*, 114*a* are deposited with a second coating including a metal and frit. The metal may be precious. In particular, the metal is silver. The frit content in the second coating is greater than the first coating. In an aspect, the frit content is at least 20% greater in the second coating. The first coating also extends contiguously within the through-holes 150 from the top surface 120 to the bottom surface 115.

In an aspect, a portion of metallized area 121 is present in the form of resonator pads (121*a* is representative). Each of these resonator pads partially surrounds a through-hole 150 opening located on the top, recessed surface 120. In an exemplary aspect, each resonator pad entirely surrounds one of through-holes, respectively. The resonator pads are contiguous with the metallization area 121 that extends through the inner surfaces of the through-holes. Resonator pads 121*a* are shaped to have predetermined capacitive couplings to adjacent resonators and other areas of surface-layer metallization.

An un-metallized area or pattern 122 extends over portions of top surface 120. Unmetallized area 122 surrounds all of the metallized resonator pads 121*a*. In addition, portions of inner planar walls 113*b*, 114*b* and roofs 113*a*, 114*a* are un-metalized.

Un-metallized area 122 extends on the top surface 120 in slot 122*a* (122*a* is representative). The un-metallized area 122 also extends onto side wall slot portions 122*a*', 122*a*" (122*a*' and 122*a*" are representative). Side wall slot portions 122*a*' and 122*a*" define opposed side walls of the post 135.

In another aspect, un-metallized area 122 also can also extend onto a portion 123 of side surface 112 located below the post 135. Portion 123 can also extend below the slots 130. These un-metallized areas co-extensive or joined or coupled with each other in an electrically non-conducting relationship.

The surface-layer pattern of the filter 100 additionally defines a pair of isolated conductive metallized areas 124*a*, 124*b* for input and output connections to filter 100. An input connection area or electrode 124*a* and an output connection area or electrode 124*b* are defined on top surface 120 and extend onto a portion of the planar wall 114 and side surface 112. The electrodes can serve as surface mounting conductive connection points or pads or contacts. Electrodes 124*a*, 124*b* are located adjacent and parallel to side surfaces 111.

Each of the electrodes is located between two resonator pads 121*a-f*. Electrodes 124*a*, 124*b* are surrounded on all sides by un-metallized areas 122.

In another aspect, the recessed surface pattern 120 includes metallized 121 areas and un-metallized 122 areas. As a result, metallized areas are spaced apart from one another and capacitively coupled. The amount of capacitive coupling is roughly related to the size of the metallization areas and the separation distance between adjacent metallized portions as well as the overall core configuration and the dielectric constant of the core dielectric material. Similarly, surface pattern 120 also creates inductive coupling between the metallized areas.

Figure 2:
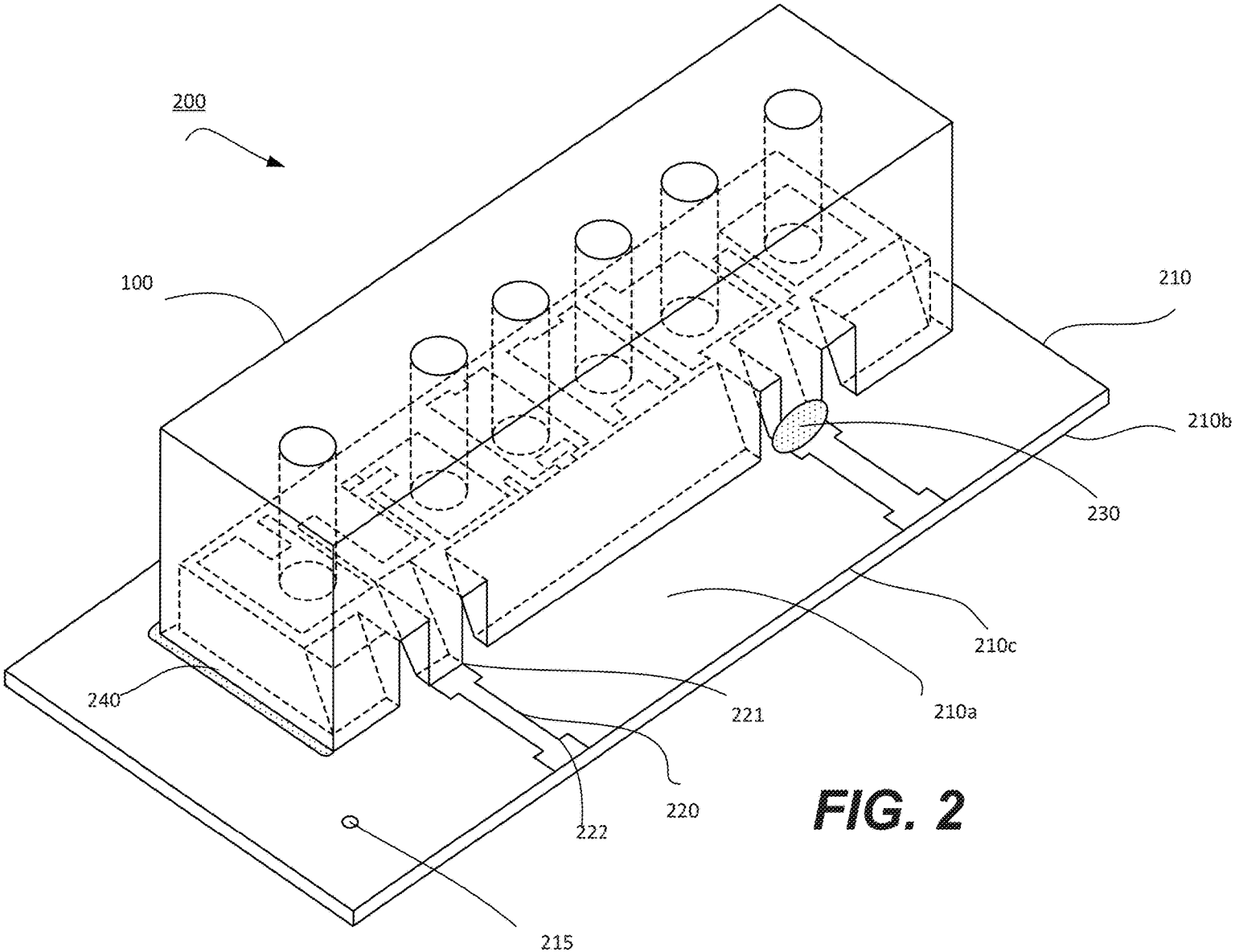
FIG. 2 illustrates printed circuit board on which the ceramic filter is attached, according to the application.

According to another aspect, the filter 100 is illustrated as being mounted to a generally planar rectangular shaped circuit board 210 in FIG. 2. In one aspect, circuit board 210 is a printed circuit board having a top or top surface 210*a*, bottom or bottom surface 210*b* and sides or side surfaces 210*c*. Circuit board 210 has a height of a predetermined thickness. Circuit board 210 also includes plated through-holes 215 that form an electrical connection between the top and the bottom of the circuit board 210. Several circuit lines 220 and input/output connection pads 221 can be located on top the top surface and connected with terminals 222. Circuit lines 220, connection pads 221, and terminals 222 can be formed, for example, from metal such as copper. Terminals 222 connect the filter 100 with an external electrical circuit (not shown).

A post of the filter 100 can be attached to the PCB 200 at the connection pad(s) 221 by solder 230. In an aspect, one or both of the input 124*a* and output 124*b* electrodes can be attached to the solder 230.

Circuit board 200 has a generally rectangular-shaped ground ring or line 240. It can be disposed on the top surface. The line 240 can be formed around the rim of the filter. The ground ring can be formed from copper. Next, the filter 100 can be placed on top 302 such that input electrode portion 124*a* and output electrode portion 124*b* are aligned with connection pads 221. Circuit board 200 and filter 100 may be arranged in a reflow oven to melt and reflow the solders.

As illustrated in FIG. 2, filter 100 is mounted to the board 200 in a top side down relationship. As a result, the top surface 120 is located opposite, parallel to, and spaced from the top 210 of board and the rim of 113*a*, 114*a* of the filter are soldered to the top of the PCB 200. In this relationship, cavity 125 is partially sealed to define an enclosure defined by the top-recessed surface 120, the board surface 210*a*, and the walls 111, 112 of the filter. It is further noted that, in this relationship, the through-holes in filter are oriented in a relationship generally normal to the board 200.

The use of filter 100 with recessed top surface pattern 120 facing and opposite the board provides improved grounding and off band signal absorption, and confines the electromagnetic fields within cavity 125. The arrangement also prevents external electromagnetic fields outside of cavity 125 from causing noise and interference such that the attenuation and zero points of the filter are improved. The technology allows the same footprint to be used across multiple frequency bands. In addition, during solder reflow, filter 100 tends to self-align with the ground ring 240 on the circuit board.

The use of a filter 100 defining a cavity and a recessed top surface pattern 40 facing and opposite the board 200 eliminates the need for a separate external metal shield or other shielding as currently used to reduce spurious electromagnetic interference incurred. However, this means any tuning to be carried out for the filter 100 after attachment to the board 200 cannot be carried out on the top-recessed surface 120 unless the whole filter 100 is taken off the board 200.

Accordingly, the better the filter 100 is designed, fabricated, characterized, and/or tuned prior to attachment to the board 200, the more reliable and cost-efficient the overall operation and use of the filter 100 becomes. Various aspects of this application address these issues and provide efficient and fast methods and systems to design, tune and produce such ceramic filters.

Figure 3:
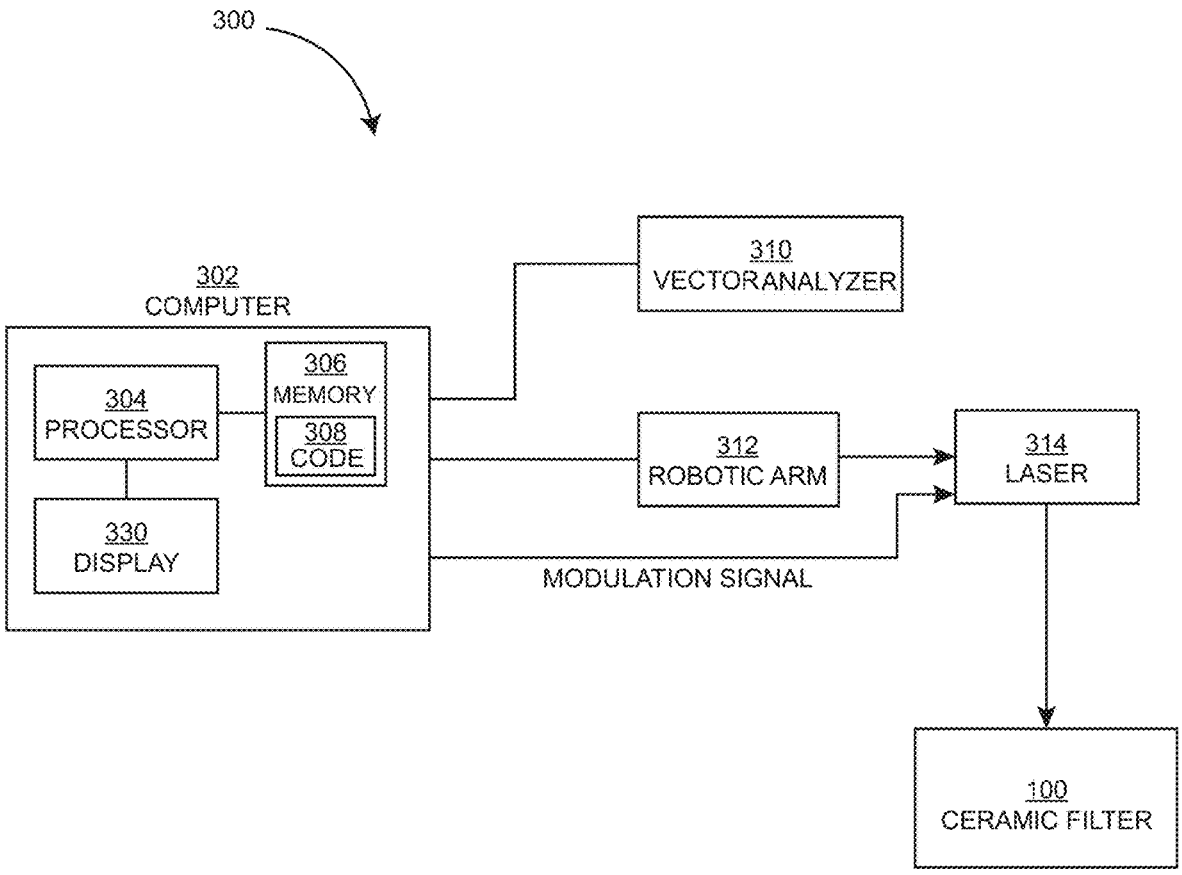
FIG. 3 illustrates a system, according to the application.

Referring to FIG. 3, a system 300 for laser based tuning of ceramic filters is provided, in accordance with an aspect of this disclosure. The system 300 includes a computer 302, a vector network analyzer 310, a robotic arm or other opening device for tuning 312, and a laser 314. The computer 302, the vector network analyzer 310, the robotic arm 312, and the laser 314 are all configured to design, tune and produce a tuned ceramic filter, e.g., the filter 100.

The computer 302 includes a processor 304. A memory 306 is coupled to the processor 304, the memory 306 having non-transitory computer readable medium 308 on which are stored instructions/computer code for laser tuning a recessed top ceramic filter, e.g., the filter 100. The instructions when executed by the processor 304 cause the processor 304 to carry out a simulation, design, characterization, tuning and production of the filter 100, as described with respect to FIGS. 4-7. The computer 302 is specially configured to carry out these aspects of the present application, as will be understood by one of ordinary skill in the art in view of this application.

In one aspect of this application, the computer 302 is coupled to a vector network analyzer 310 configured to provide a frequency domain and/or a time domain response of the filter 100 to various signals (e.g., electrical or mechanical test signals) to characterize and test the filter 100. Alternatively, the vector network analyzer 310 may be part of the computer 302.

In one aspect of this application, the computer 302 is coupled to and/or in communication with a robotic arm 312. The robotic arm 312 facilitates opening and closing of the test fixture. When open, the test fixture permits measurement on the vector network analyzer. The robotic arm 312 is coupled to the laser 314. The computer 302 may send control signals to move the robotic arm 312, and hence the laser 314 to one or more precise locations on the filter 100. The computer 302 may then send additional control signals (e.g., a modulation signal) to the laser 314 for outputting laser pulses on to the precise locations on the filter 100 where the ceramic material is to be removed.

In one alternative aspect of this application, the robotic arm 312 may be optional, and the laser 314 may be positioned manually above a desired location on the filter 100. Still alternatively, the laser 314 may not be moved, and instead the filter 100 may be moved using the robotic arm 312. Further, in one aspect, both the laser 314 and the filter 100 may be moveable by the robotic arm 312 to be in a precise orientation relative to each other.

In one aspect of this application, the laser 314 is a femto-second laser. The femto-second laser can emit optical pulses of up to 1 femto-second duration. An exemplary advantage of this duration is that the ceramic material on the filter 100 is ablated but does not burn off or overheat the filter 100. Another exemplary advantage of using the laser 314 is that a high degree of precision removal of the tune material (ceramic material) is possible, as compared to a coarser removal using a drill.

Design Method for a Ceramic Filter

Conventional design process for these filters currently involves first simulating the filter 100, which results in an accurate prediction of the final filter performance but does not provide much instruction how to achieve the final performance. Conventionally, the designer must use a laborious and expensive process that requires significant knowledge of the art to design the printed pattern that will yield the originally simulated performance.

Figure 4:
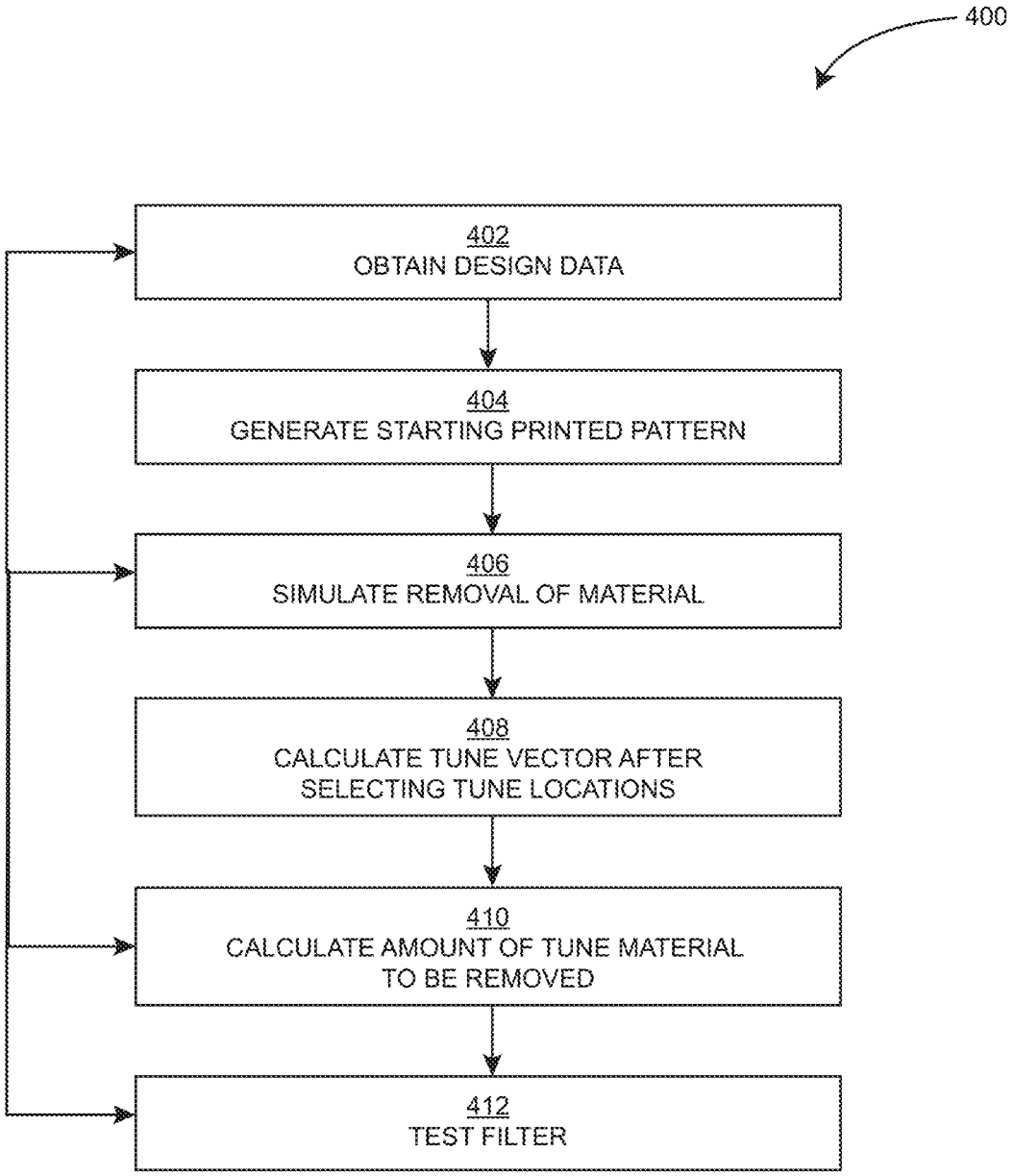
FIG. 4 illustrates a filter design method, according to the application.

According to an aspect of this application, FIG. 4 describes an iterative design process 400 that addresses the issues faced in conventional design of the ceramic filter 100. The design process 400 (shown as a flowchart) may begin in a step 402 where design data describing achievable electrical performance of the finished design of the filter 100 are obtained from the memory 306. This may be based on past design data. For example, simulated S-parameters converted to time-domain representation may be obtained and displayed on a display 330 of the computer 302. An initial engineering estimated design of the printed pattern may be obtained as part of the design data in the step 402.

In a step 404, a starting printed pattern of the filter 100 may be generated from the design data in the step 402. This may be performed via a software program. The generated starting pattern may be an oversized pattern for the simulated version of the filter 100. The oversized pattern is "oversized" with respect to extra amount of ceramic material deposited on the filter 100. This pattern is best chosen as a first estimate by an experienced designer or, alternatively, a generic pattern that is not particularly close to the correct performance. The oversized pattern may be shown printed on a simulated version of the filter 100. Simulated results in the frequency domain, time domain, or a coupling matrix format may be used to generate the starting pattern. Starting with simulated data, a pseudo vector space, related to either a matrix representation or another (matrix-like) set of data points that represent the items that may need tuning (e.g., resonator center frequencies, complex value or magnitude of coupling coefficients) may be defined. Alternatively or additionally, the oversized pattern may be printed on the filter 100 in real time as the simulation of the oversized pattern is generated.

In a step 406, the design process 400 may simulate removal of small amounts of conductive material at many possible tune locations and iteratively measure to determine each effect on the matrix representations. The goal is to find tune locations that have a strong effect on the center frequency of each resonator of the filter 100 or the simulated filter, and on the strength of each coupling between resonators. In one embodiment, a tune location is sought such that it exhibits a strong effect on the center frequency on one resonator and a minimal effect on the other resonators. In another embodiment, a tune location is sought such that it exhibits a strong effect on the coupling between two particular resonators and a minimal effect of coupling among other resonators, and a minimal effect on the center frequencies of other resonators.

Figure 5:
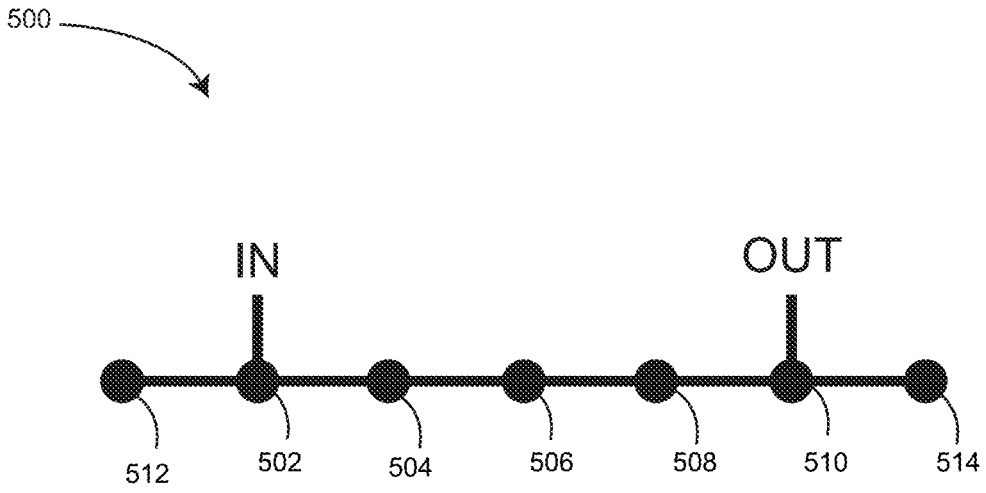
FIG. 5 illustrates a filter pole schematic, according to the application.

For example, FIG. 5 illustrates at a high level, a schematic diagram of the filter 100 as a bandpass filter. The schematic of FIG. 5 is for a 5-pole multiple element filter which is formed from the cascade of five resonators 502, 504, 506, 508, and 510, between an input port (IN) and an output port (OUT), although higher or lower number of resonators may be present on the filter 100. The resonators 502-510 are similar to the resonators formed by the through holes 150 shown in FIG. 1. In this example, two shunt zeros 512 and 514 are formed by the two outermost dangling resonators. Each of the resonators 502-514 has a plated hole through the bulk of the ceramic and a printed pattern that is electrically connected to the plated hole. Each printed pattern is coupled through an electric field to the printed pattern of another resonator or to the input or output port by use of the non-conductive gaps between the plated patterns, as also shown with respect to FIGS. 1-2. It may also be coupled through the magnetic field through the bulk of the ceramic material that exists between the through-holes.

Ideally, each tune location is chosen such that it has a strong effect on one tune result (e.g., resonator 504 center frequency, or e.g., resonator 502-resonator 504 coupling) and a weak effect on other tune results. This tuning location may be thought of intuitively as an adjustment knob whereby removal of material corresponds to a change in primarily one item of interest. In one aspect, optionally or additionally, a subset of the originally-chosen tune locations that best match an orthogonal vector space into the chosen coupling matrix may be selected as part of the design process 400. More precisely, this tuning location may be thought of as one dimension in a pseudo vector space with total number of dimensions equal to the number of items that require tuning. The selection of tune locations may occur with intervention by a designer or, alternatively, may be originally an over-generalized set of locations. Further, if in the step 404, an actual oversized pattern was printed from based on the simulated pattern, then the removal step maybe performed at the actual tune locations of the filter 100 also.

In a step 408, a tune vector may be calculated based upon observing the difference between the existing performance of the filter 100 and the simulated reference of the filter 100. In one aspect, the calculated tune vector may be compared with an actual tune vector of the filter 100. The tune locations may be chosen from a number of the possible tune locations that compose the vector space. Generally, locations are chosen based on how well they correlate to or match the desired tune vector. Additionally, the coefficients of the tune vector may be weighted so that each location has a specific impact on the overall tune vector space.

Simulated filter performance is used as a reference that shows the expected performance of the finished design. These data can be converted back-and-forth between either the frequency domain or the time domain. Typically, filter specifications are given in the frequency domain and this representation can be used to set goals or limit values to check against during tuning. Important characteristics of a filter are:

(a) low insertion loss 1, within a specified tolerance in the pass-band, $s_{12}$, from the input port towards the output port;

(b) low return loss 3, within a specified tolerance in the pass-band, $s_{11}$, between the input port and the input port, which characterizes the amount of energy which was input to the filter but which is reflected back from the input port at various frequencies; and (c) low return loss 2, within a specified tolerance in the pass-band, $s_{22}$, between the output port and the output port which characterizes the amount of energy which was input to the output port but which is reflected back from the output port at various frequencies.

Other indicators of filter performance are: the level of attenuation of the input signal outside of the pass-band and the return losses $s_{11}$ and $s_{22}$ outside of the pass-band of interest. Also, depending on application needs, the insertion loss, $s_{21}$, between the output port and the input port, may be of importance.

In a step 410, the amount of tune (material removal) needed to reach the goal may be calculated. The calculated amount of tune may be reduced by a scaling factor or similar adjustment, for example, based upon the weight in the tune vector space. The calculated amount of tune material may be removed from the filter 100 and/or the simulated filter at one or more selected tune locations. By successive removal of material and observation of the effect, the set of tune locations can be reduced in number by selecting only those locations that best fit an orthogonal vector space. At this point, it is determined the magnitude and direction of effect that corresponds to a certain amount of material removed. This direction and magnitude is referred to as a pseudo unit vector.

For example, removal of conductive material between resonator 502 and resonator 504 may be found to primarily affect coupling between resonator 502 and resonator 504, yet have little effect on coupling between other resonators and little effect on the center frequencies of other resonators. This would therefore be a good tune location for resonator 1-2 coupling. Continuing in this example, removal of about 2-3 microns of conductive material has an effect of adjusting resonator 502 resonator 504 coupling by a unit value. For example, this unit value could be a reduction in the height of the time-domain response by 1 division on the vector network analyzer 310. As an alternate example (using a coupling matrix representation), this unit value could be chosen as a change in the resonator 502-resonator 504 matrix element by a minimum the desired final value. Multiple transformations of the data may be carried out to correctly determine each resonator frequency and each coupling value, due to the interrelationships among these items. In other words (considering a time domain representation), an initially poorly-tuned resonator 502 resonator 504 coupling will have the tendency to mask the measurement of resonators 506, 508, etc., that follow that location, leading to inaccuracies in those measurements, until the resonator 502 resonator 504 coupling is more properly tuned. Time gating these measurements and reconfiguring the vector network analyzer 310 can allow accurate measurement of, say, resonator 506 but inaccurate measurement of resonator 502.

Reconfiguring the measurement would then allow accurate measurement of resonator 502 but not resonator 506, etc.

Removal of the ceramic material may be done for the filter 100 using the laser 314 for precise removal. Alternatively, for coarser removal during initial iterations, a drill cutter may be used. Selection of which resonator(s) or coupling(s) should be tuned first and which should be tuned next and so on may be performed by the computer 302 using multiple transformations of the data to correctly determine each resonator frequency and each coupling value, due to the interrelationships among these items. A property to tune is chosen by comparison of the filter 100 under design to a reference filter. A location (optionally, multiple simultaneous locations) to tune is then chosen which best correlates or matches the desired property to tune. Optionally, a step-by-step method may be used to inform or to weight the selection since tuning one item may affect another item and since the measurement of one desired item may be inaccurate due to a masking effect of another item.

The amount of tune material is then calculated based on a vector or pseudo-vector derived from the pseudo unit vector from the step 408 multiplied by an amount required to change the desired response from the existing performance to the reference filter. This amount is then reduced by a scaling factor or a subtracted amount that ensures the approach will converge in one direction only (by removal of ceramic material, not addition).

Figure 6:
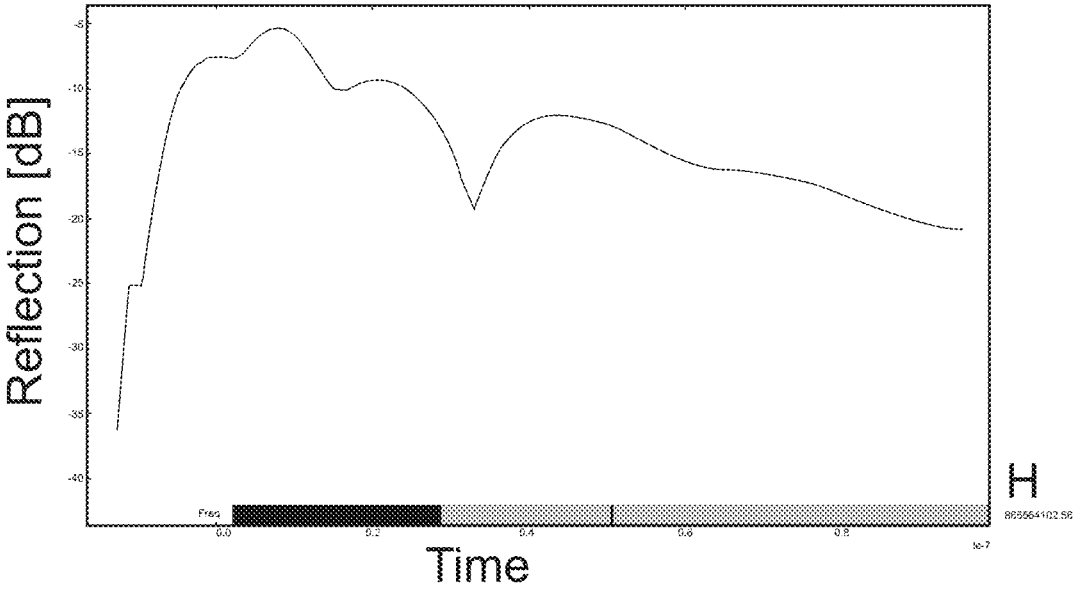
FIG. 6 illustrates a time-domain representation, according to the application.

In a step 412, the filter 100 and the simulated filter with the ceramic material removed may be tested again to determine how close the filter 100 and/or the simulated filter is/are to the design goals. For example, various coupling matrix coefficients may be measured. The overall performance of the filter 100 may also be shown in the time domain as illustrated in FIG. 6. Here, as an example, a given return loss is shown where the reflection level is indicated in dB against a nanosecond time scale. As a given signal propagates from a given node through the resonators 502-514 of the filter 100, the energy returns occur at delays encountered as the signal propagates. Similar time domain representations apply for other parameters such as $s_{12}$ and $s_{21}$. Mathematically, a frequency domain representation can be transformed to the time domain and vice versa using well known techniques. In addition, many Vector Network Analyzers (e.g., the vector network analyzer 310) can provide both frequency and time domain characterizations of a given filter.

Measurement and comparison of the filter 100 against the reference filter and against other design goals (possibly in the frequency domain). If the filter 100 passes requirements, the process 400 is complete. Otherwise, the iterative approach is followed by returning to step 408. Optionally, the process may return to step 410, which allows for a less ideally orthogonal tune vector space but may improve convergence time to the desired result. For example, the steps 402-412 may be repeated iteratively for modifying the simulated data and the amount of the ceramic material removed such that the tune vector and the simulated tune vector match. For example, the difference between the tune vector of the filter 100 and the simulated tune vector may converge to zero.

According to an aspect of this application, the iterative design process 400 operates on a printed filter, including a ceramic RTP duplex filter (duplexer), e.g., the filter 100. To carry out the iterative design process 400, various pieces of information are taken into consideration such as: (i) design data describing achievable electrical performance of the finished design. (i.e., simulated S-parameters converted to time-domain representation); (ii) an initial engineering estimated design of the printed pattern; (iii) the ability to simultaneously measure and tune the filter, or the ability to go between measurement and tune steps in quick succession; (iv) the computer 302 for running software for calculations; and (v) means of displaying calculated results (e.g., the display 330).

Tuning Method for a Ceramic Filter

Figure 7:
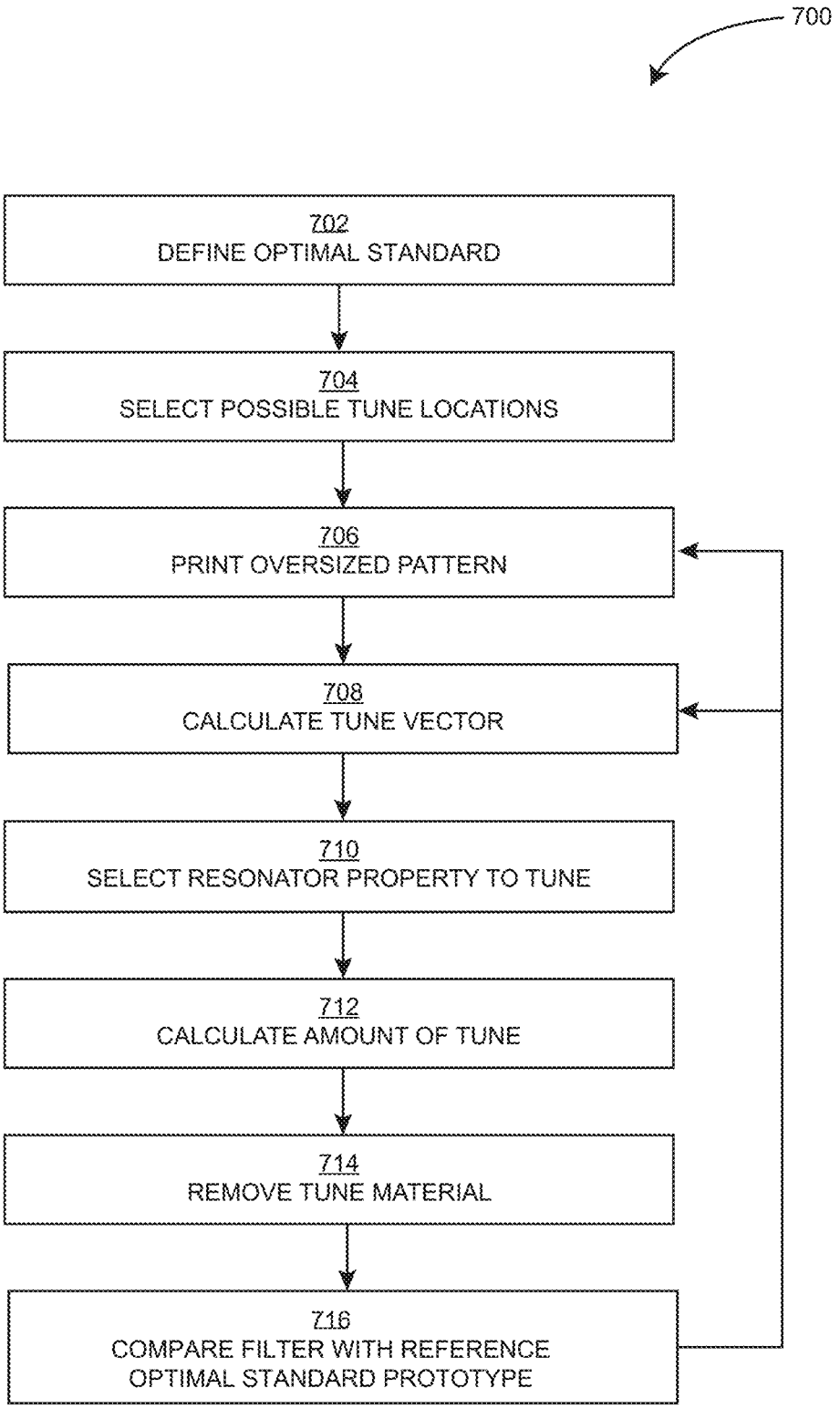
FIG. 7 illustrates a filter tuning method, according to the application.

Referring to FIG. 7, a method 700 for tuning the ceramic filter 100 is illustrated. The tuning method 700 may begin in a step 702 where a reference filter, e.g., electrical representation, from a measured existing product (an already characterized ceramic filter) is defined. The gold optimal standard may include storing electrical of an ideal ceramic filter that matches the design goals (e.g., properties defined in the design process 400) in the memory 306 of the computer 302. Measured data describing achievable electrical performance of the finished design of the filter 100 may be included as part of the gold standard. For example, measured S-parameters from an existing prototype or production sample may be used for tuning the filter 100.

In a step 704, a selection of possible tune locations of the filter 100 to be tuned is carried out. The goal is to find locations that have a strong effect on the center frequency of resonators 502-510 and the coupling between the resonators 502-510. Ideally, a tune location is chosen that has a strong effect on one tune result and a weak effect on other tune results. This tuning location may be thought of intuitively as an adjustment knob whereby removal of material corresponds to a change in primarily one item of interest. More precisely, this tuning location may be thought of as one dimension in a pseudo vector space with total number of dimensions equal to the number of items that require tuning. The selection of tune locations may occur with intervention by a designer or, alternatively, may be originally an over-generalized set of locations. Then, by successive removal of material and observation of the effect, the set of tune locations can be reduced in number by selecting only those locations that best fit an orthogonal vector space. At this point, it is determined the magnitude and direction of effect that corresponds to a certain amount of material removed, referred to as a pseudo unit vector. Multiple transformations of the data may be carried out to correctly determine each resonator frequency and each coupling value, due to the interrelationships among these items.

In a step 706, an oversized pattern that was determined from starting with the reference is printed on the filter 100 and the size of the pattern at experimentally determined possible tune locations from the previous step 704 is increased. Step 706 may occur before or after step 704. A starting point is selected where the pattern to be adjusted starts out larger than needed, at least in the locations that will be later tuned by removal of material from the filter 100. The starting pattern originates as the pattern of the reference, which is the result of an earlier design process, e.g., the design process 400.

In a step 708, a tune vector based on observing the difference between the existing performance and the measured reference is calculated. Such calculating includes a comparison of the existing measured filter performance against the reference. This comparison is ideally in the form of a difference between one of several matrix representations of the filter 100 but may be based on a format that is derived from the graphical time-domain representation of the filter 100 (e.g., that shown in FIG. 6).

In a step 710, selection of which resonator(s) or coupling(s) should be tuned first and which should be tuned next and so on is carried out. Multiple transformations of the data may be carried out to correctly determine each resonator frequency and each coupling value, due to the interrelationships among these items. A property to tune is chosen by comparison of the filter 100 under design to the reference. A location (optionally multiple simultaneous locations) to tune is then chosen which best correlates or matches the desired property to tune. Optionally, a step-by-step method taught may be used to inform or to weight the selection since tuning one item may affect another item and since the measurement of one desired item may be inaccurate due to a masking effect of another item.

In a step 712, the amount of tune is calculated based on a vector or pseudo-vector derived from the pseudo unit vector from the step 710 multiplied by the amount required to change the desired response from the existing performance to the reference. This amount is then reduced by a scaling factor or a subtracted amount that ensures the approach will converge in one direction only (by removal of material, not addition).

In a step 714, removal of material at the calculated locations and in the calculated amount is carried out by the laser 314 following the guided computer executable instructions given by the computer 302. Alternatively, a technician may perform such removal using instructions and numerical values from the computer 302.

In a step 716, measurement and comparison of the filter 100 against the reference and against any design goals (e.g., in the frequency domain) is carried out. If the filter 100 passes these requirements, the process 700 is complete. Otherwise, an iterative approach is followed by returning to step 708. Optionally, the process 700 may return to step 706, which allows for a less ideally orthogonal tune vector space and may improve convergence to the desired result. For example, the difference between the tune vector of the filter 100 and the reference filter may converge to zero.

While the system and method have been described in terms of what are presently considered to be specific embodiments, the disclosure need not be limited to the disclosed embodiments. It is intended to cover various modifications and similar arrangements included within the spirit and scope of the claims, the scope of which should be accorded the broadest interpretation so as to encompass all such modifications and similar structures. The present disclosure includes any and all embodiments of the following claims.

What is claimed is:

1. A method of making a tuned ceramic filter, comprising:

printing an oversized pattern of electrically conductive metallized ceramic material on a ceramic filter;

removing, at a first tune location of the ceramic filter, a first amount of the electrically conductive metallized ceramic material using a laser to shrink the oversized pattern;

comparing a coupling matrix of the ceramic filter after the removing step with a coupling matrix of a prototype of the ceramic filter;

generating a tune vector based upon a difference between the coupling matrix of the ceramic filter and the coupling matrix of the prototype filter; and iteratively modifying the removing of the electrically conductive metallized ceramic material using a femto-second laser at the first tune location to have a coefficient of the tune vector corresponding to the first tune location to converge toward zero.

2. The method of claim 1, further comprising:

performing the removing, the comparing, the generating and the iteratively modifying steps at additional locations of the ceramic filter to reduce respective additional coefficients of the tune vector to zero.

3. The method of claim 1, wherein the tune vector is formed from a difference of measurements of coupling coefficients in the coupling matrix of the ceramic filter and the coupling matrix of the prototype filter during a given iteration.

4. The method of claim 1, wherein the first tune location is between two shunt zero locations of the ceramic filter.

5. The method of claim 1, wherein the first tune location corresponds to a local minimum in a reflectance characteristic in a time domain response of the ceramic filter.

6. The method of claim 1, wherein the removing step is carried out for a recessed top portion of the ceramic filter.

7. The method of claim 1, wherein the first tune location is chosen such that only one of the coefficients of the coupling matrix of the ceramic filter is modified by the removing step and additional coefficients of the coupling matrix of the ceramic filter are unaffected by the removing step.

8. The method of claim 1, wherein the comparing step includes measuring at least one electrical property of the ceramic filter after the removing step.

9. The method of claim 1, wherein the femto-second laser is controlled to emit pulses of at most 1 femto-second.

10. A system for laser based tuning of ceramic filters, comprising:

a processor;

a memory coupled to the processor, the memory having non-transitory computer readable medium on which are stored instructions for laser tuning a recessed top ceramic filter, the instructions when executed by the processor cause the processor to:

position a femto-second laser source to a first tune location of the recessed top ceramic filter, the first tune location is selected based upon simulated data of electrical characteristics of the recessed top ceramic filter, the first tune location having an oversized pattern of electrically conductive metallized ceramic material;

turn-on the femto-second laser to emit a femto-second pulse on the electrically conductive metallized ceramic material of the first tune location;

measure electrical characteristics of the recessed top ceramic filter after a removal of a portion of the electrically conductive metallized ceramic material by the femto-second laser source to generate a tune vector;

compare the tune vector with a simulated tune vector corresponding to simulated data for the recessed-top ceramic filter, each of the tune vector and the simulated tune vectors being derived from an actual coupling matrix and a simulated coupling matrix, respectively, of the recessed-top ceramic filter; and iteratively modify the simulated data and the amount of the electrically conductive metallized ceramic material removed such that the tune vector and the simulated tune vector match.

11. A method for designing a ceramic filter, comprising:

printing an oversized pattern of electrically conductive metallized ceramic material on a ceramic filter;

selecting, a first tune location of the ceramic filter, based upon simulated data of electrical characteristics of the ceramic filter;

removing, at the first tune location, an amount of the electrically conductive metallized ceramic material using a femto-second laser to shrink the oversized pattern;

measuring actual electrical characteristics of the ceramic filter after the removing step to generate a tune vector for the ceramic filter;

comparing the tune vector with a simulated tune vector corresponding to the simulated data, wherein the tune vector and the simulated tune vector being derived from an actual coupling matrix and a simulated coupling matrix, respectively, of the ceramic filter; and iteratively modifying the simulated data and the amount of the electrically conductive metallized ceramic material removed such that the tune vector and the simulated tune vector match.

12. The method of claim 11, further comprising:

performing the selecting, the removing, the measuring, the comparing, the generating and the iteratively modifying steps at additional locations of the ceramic filter to match respective coefficients of the tune vector to coefficients of the simulated tune vector.

13. The method of claim 11, wherein the tune vector is formed from a difference of measurements of coupling coefficients in the actual coupling matrix during a given iteration.

14. The method of claim 11, wherein the first tune location is between two shunt zero locations of the ceramic filter.

15. The method of claim 11, wherein the first tune location corresponds to a local minimum in a reflectance characteristic in a time domain response of the ceramic filter.

16. The method of claim 11, wherein the removing step is carried out for a recessed top portion of the ceramic filter.

17. The method of claim 11, wherein the first tune location is chosen such that only one coefficient of the actual coupling matrix is modified by the removing step and additional coefficients of the coupling matrix are unaffected by the removing step.

18. The method of claim 11, wherein the femto-second laser is computer controlled to emit pulses of 1 femto-second or lesser.

19. The method of claim 11, wherein the comparing step includes measuring at least one electrical property of the ceramic filter after the removing step.

* * * * *